US006370732B1

(12) United States Patent
Yezersky et al.

(10) Patent No.: US 6,370,732 B1
(45) Date of Patent: Apr. 16, 2002

(54) DOOR CHECK MECHANISM PROVIDING AN INFINITE NUMBER OF STABLE POSITIONS

(75) Inventors: Grigory Yezersky, Farmington Hills; Gerald Cilibraise, Livonia, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/656,383

(22) Filed: Sep. 6, 2000

(51) Int. Cl.[7] ..... E05F 5/06

(52) U.S. Cl. ..... 16/85; 16/86 A; 16/86 B; 16/82; 292/275; 292/262

(58) Field of Search ..... 16/85, 86 A, 86 B, 16/86 C, 82, 334, 331, 332; 296/146.9, 146.11, 146.12; 277/634, 635, 936, 921; 292/275, 262, 73, 75, DIG. 19

(56) References Cited

U.S. PATENT DOCUMENTS

| | | | | |
|---|---|---|---|---|
| 2,032,600 | A | | 3/1936 | Smith |
| 2,237,046 | A | | 4/1941 | Breitenwischer |
| 2,290,331 | A | | 7/1942 | Jacobs |
| 2,321,409 | A | | 6/1943 | Moore |
| 2,693,616 | A | | 11/1954 | Cromwell et al. |
| 2,724,143 | A | | 11/1955 | Galla |
| 2,787,019 | A | | 4/1957 | Galla |
| 2,860,369 | A | | 11/1958 | Galla |
| 2,980,945 | A | | 4/1961 | Hollar, Jr. |
| 3,012,269 | A | | 12/1961 | Bartel |
| 3,051,983 | A | | 9/1962 | Dale |
| 3,369,833 | A | | 2/1968 | Schaldenbrand |
| 3,979,790 | A | | 9/1976 | Chiarappa |
| 3,980,331 | A | | 9/1976 | Kennedy et al. |
| 4,048,695 | A | | 9/1977 | Juilfs et al. |
| 4,194,264 | A | | 3/1980 | Stoffregen |
| 4,658,468 | A | | 4/1987 | Tillmann et al. |
| 4,663,801 | A | | 5/1987 | Maloposki, Jr. |
| 4,692,960 | A | * | 9/1987 | Jozefczak ..... 16/86 A |
| 4,738,003 | A | * | 4/1988 | Mori et al. ..... 16/368 |
| 4,785,493 | A | | 11/1988 | Tillmann et al. |
| 4,788,743 | A | | 12/1988 | Okumura |
| 4,833,755 | A | | 5/1989 | Bonin |
| 4,841,600 | A | | 6/1989 | Sasamura et al. |
| 4,858,952 | A | * | 8/1989 | Sasaki et al. ..... 292/265 |
| 4,912,806 | A | | 4/1990 | Orii et al. |
| 5,074,010 | A | | 12/1991 | Gignac et al. |
| 5,152,030 | A | | 10/1992 | Cogo |
| 5,173,991 | A | | 12/1992 | Carswell |
| 5,361,540 | A | * | 11/1994 | Rogers, Jr. et al. .. 292/DIG. 46 |
| 5,474,344 | A | | 12/1995 | Lee |
| 5,727,287 | A | | 3/1998 | Hosken et al. |
| 5,862,570 | A | | 1/1999 | Lezuch et al. |
| 6,065,185 | A | | 5/2000 | Breed et al. |
| 6,237,190 | B1 | * | 5/2001 | Grumm et al. ..... 16/82 |

* cited by examiner

*Primary Examiner*—Chuck Y. Mah
(74) *Attorney, Agent, or Firm*—Mark P. Calcaterra

(57) ABSTRACT

A vehicle door checkstrap assembly is provided including an arm having the first end engaged to the frame and a second end interconnected to a brake member within the vehicle door. The brake member cooperates with a carriage assembly which slidably engages a guide track incorporated in the vehicle door. A load is exerted from the brake member toward a support face within the door which creates a braking force when the door is in a static state. When the door is moved, the opening force is capable of overcoming the friction between the brake member roller and the supporting face allowing free motion of the door along the guide path. The roller carriage assembly operates such that the door can be located securely in an infinite number of positions between fully open and closed.

8 Claims, 2 Drawing Sheets

DOOR CHECK MECHANISM PROVIDING AN INFINITE NUMBER OF STABLE POSITIONS

BACKGROUND OF THE INVENTION

Field of the Invention

The present invention relates generally to articulating doors for motor vehicles, and more particularly to a checkstrap assembly operative to positively locate a passenger door in an infinite number of positions between a fully open position and a closed position.

BACKGROUND OF THE INVENTION

In a conventional manner, passenger doors of motor vehicles are pivotally mounted to the vehicle body for movement between a fully open position and a closed position. Many such vehicle doors are designed to cooperate with a checkstrap which is operative for positively locating the door relative to the vehicle body. Additionally, on sloped surfaces, the checkstrap provides a mechanism to hold the door in its open position. Typically, a vehicle door will have an intermediate point between fully open and fully closed where the door will rest in a stable fashion. In situations where a space laterally adjacent to a passenger door prohibits the door from fully opening, opening of the door to the intermediate position may reduce incidents of unintentional damage.

In one common form, prior checkstraps for vehicle doors include a roller mounted to the vehicle body and an arm contoured to cooperate with the roller which is carried by the vehicle door. In this regard, the arm is formed to include one or more camming surfaces. The roller functions as the cam follower. As the door is moved between its fully opened position and its closed position, the arm remains in constant engagement with the roller. When the door is gently opened or closed, the cam surfaces of the arm and the roller cooperatively function to positively define an intermediate position at which the door may be located relative to the vehicle body.

While known arrangements are known to be commercially acceptable, they are also limited with specific disadvantages and thereby subject to improvement. In this regard, the common roller camming arm configuration provides one set intermediate position which the door can securely rest. Usually the camming surface encourages the door to rest in one of the defined locations. This situation often requires operator to hold the door when the defined locations are not acceptable. Often the intermediate position may not be in an optimal location for a given situation. It may be desired to open the door securely in a position greater or less than the set intermediate point and leave it thereby unassisted.

SUMMARY OF THE INVENTION

It is an object of the present invention to provide a checkstrap assembly for a passenger door of a motor vehicle having an infinite number of secure door locations between the fully closed and fully open position.

It is still another object of this invention to provide a checkstrap assembly for a passenger door of a motor vehicle having a minimal amount of resistance.

In order to obtain these and other objects, the present invention provides a checkstrap assembly for a door of a vehicle which is movable in relation to a door frame between a closed position and an open position. The checkstrap assembly includes an arm passing through an aperture in the door. The arm has a first end interconnected to a hinge fastened to the frame such that the door may be selectively moved relative to the arm. A second end is adapted to cooperate with a roller assembly within the door. The roller assembly includes a brake disk, carriage slot and guide. The roller assembly is configured such that the brake disk is always under load, which can be exerted through a spring, weight, magnet or equivalent. The load is exerted from the brake disk onto the supporting face within the housing which creates a braking force when the door is in a static state. When the door is moved, the checking force is capable of overcoming the friction between the brake disk and the supporting face allowing free motion of the door. Carriage motion is predetermined by the guide which is affixed within the door. In a dynamic state, the arm pushes (pulls) the roller assembly across the guide causing the brake disk to move along the carriage slot and away from engagement with the inner wall. When the door stops, the brake disk tends to return to the central position which corresponds to the state of minimum potential energy and the state at which the brake disk is engaged with the supporting surface of the housing.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DESCRIPTION OF THE PREFERRED EMBODIMENTS

Figure 1:
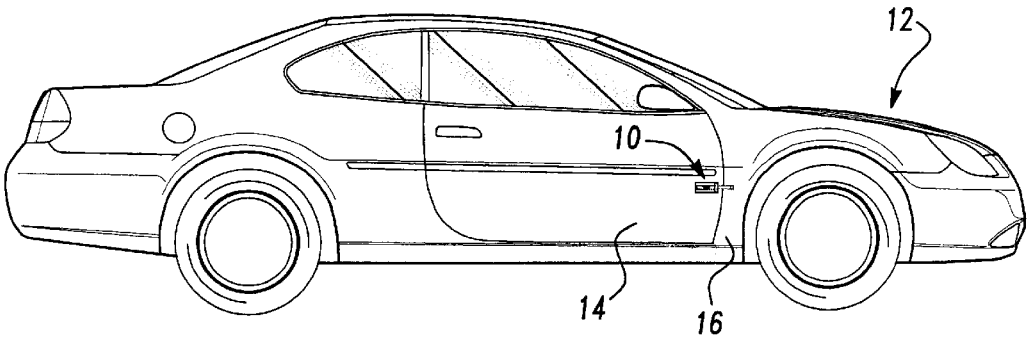
FIG. 1 is an environmental view of a checkstrap assembly constructed in accordance with the teachings of the preferred embodiment of the present invention and shown operatively installed within a vehicle so as to interconnect a passenger door with the body of the vehicle.

The present invention provides an improved checkstrap assembly specifically intended for use with a passenger door of a motor vehicle. With reference to the drawings, a checkstrap assembly constructed in accordance to the teachings of the present invention is illustrated and identified with reference numeral 10 as shown in FIG. 1. The checkstrap assembly 10 is installed on an otherwise conventional vehicle 12 and functions to operatively interconnect a passenger door 14 of the vehicle 12 with the body 16 of the vehicle 12. The intended purpose of the checkstrap assembly 10 to positively locate the door 14 in an infinite number of secure positions between a fully open and fully closed position will become apparent below.

With reference now to FIGS. 2*a*–4, the checkstrap assembly 10 of the present invention is shown to generally include a locating brake mechanism 18, a cooperating arm 20 and a mounting bracket 22. A brake disk 19 is rigidly mounted to the cooperating arm 20. The brake disk 19 is slidably mounted to a carriage slot 24 with a locating pin 27. The carriage slot 24 is slidably mounted on opposite ends with roller units 26 that engage a guide 28 affixed to the support face 31 of the housing 30. The housing 30 is suitably fastened to a forward panel 36 of the passenger door 14. The mounting bracket 22 provides a ball joint connection to the arm 20.

Figure 2A:
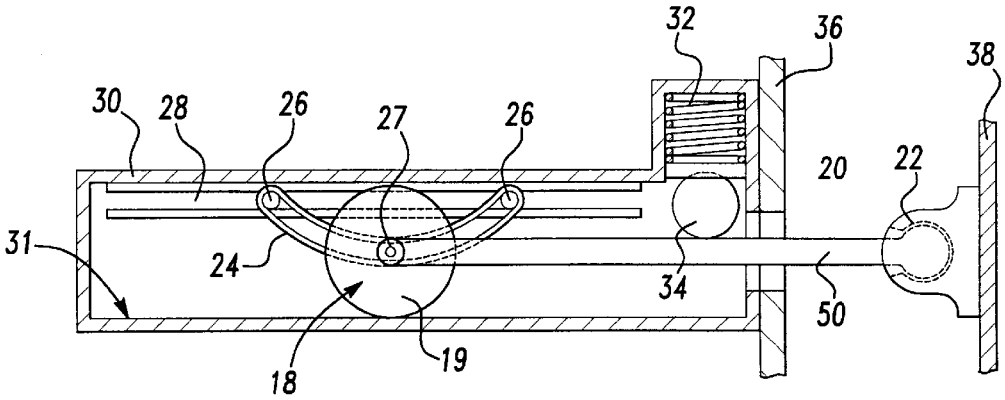
FIG. 2*a* is an enlarged perspective view of a first embodiment of the checkstrap assembly of FIG. 1 removed from the vehicle for purposes of illustration.

With reference now specifically to FIG. 2*a*, the preferred embodiment includes a biasing device including a spring 32 and ball 34 suitably recessed in the housing 30 such that tension is continuously applied to the ball 34 travelling accordingly in a channel groove (not specifically shown) on the top of the arm 20 which in turn biases the brake disk toward the support face 31 of housing 30. In an alternative configuration, turning now to FIG. 3, a torsion spring 40 is supported by the mounting bracket 22 connected to arm 20. The torsion spring 40 biases the arm 20 and, consequentially, the brake disk 19 toward the support face 31 of the housing 30.

Figure 2B:
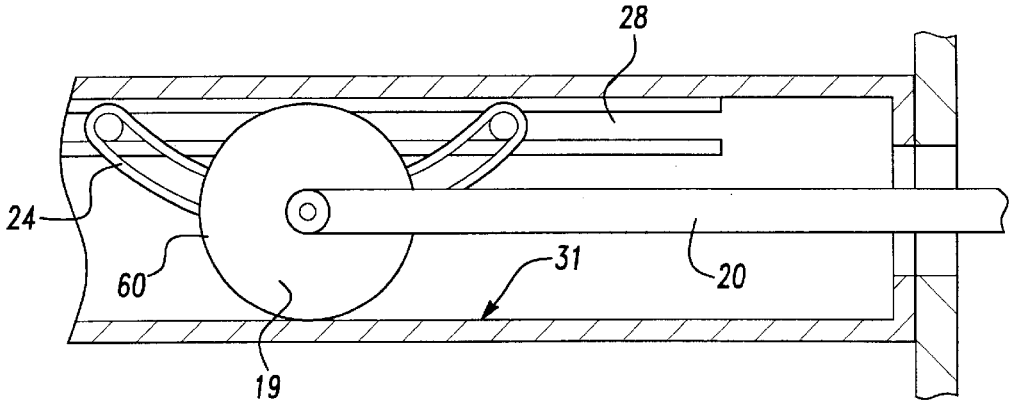
FIG. 2*b* is an enlarged perspective view of a second embodiment of the checkstrap assembly of FIG. 1 removed from the vehicle for purposes of illustration.

Referencing now FIG. 2*b*, the biasing force is generated by a magnetic strip 60 disposed around the brake disk 19. In this embodiment, the support face 31 is comprised of a metal material suitable for magnetic attraction. It is known by those skilled in the art that a magnetic material may alternatively be included on the support face 31 and the brake disk 19 may be comprised of a material suitable for magnetic attraction.

Figure 2C:
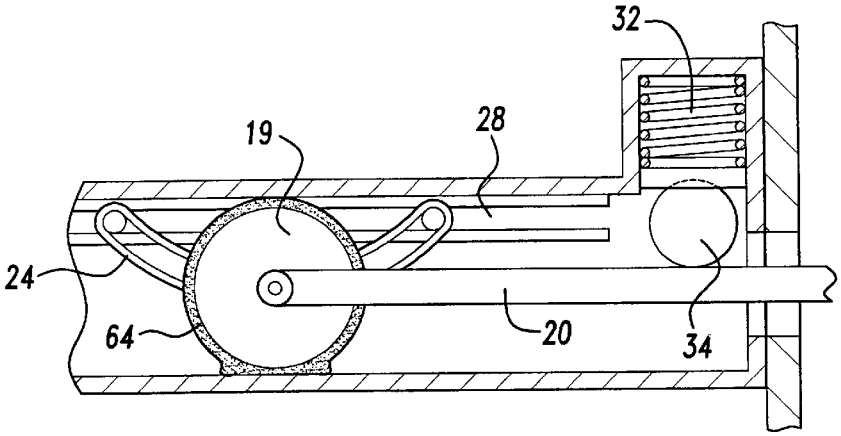
FIG. 2*c* is an enlarged perspective view of a third embodiment of the checkstrap assembly of FIG. 1 removed from the vehicle for purposes of illustration.
Figure 2D:
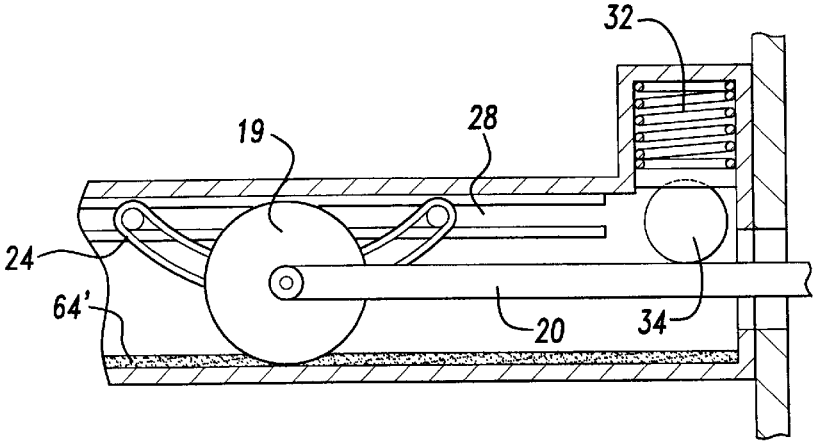
FIG. 2*d* is an enlarged perspective view of a fourth embodiment of the checkstrap assembly of FIG. 1 removed from the vehicle for purposes of illustration.

FIG. 2*c* illustrates a third embodiment wherein the brake disk 19 includes a deformable material 64 disposed thereon. FIG. 2*d* illustrates a fourth embodiment wherein the support face 31 includes a deformable material 64' disposed thereon. The deformable material 64 and 64' of FIGS. 2*b* and 2*c* may be secured by adhesive or other suitable means to the brake disk 19 or support face 31 accordingly. The deformable material 64 and 64' encourages contact between the brake disk 19 and support face 31 to provide an additional brake force to supplement the biasing force supplied by the spring 32 and ball 34. Accordingly, the embodiments of FIG. 2*c* or 2*d* may be employed to the biasing configurations of either FIG. 2*a* or FIG. 3.

Figure 3:
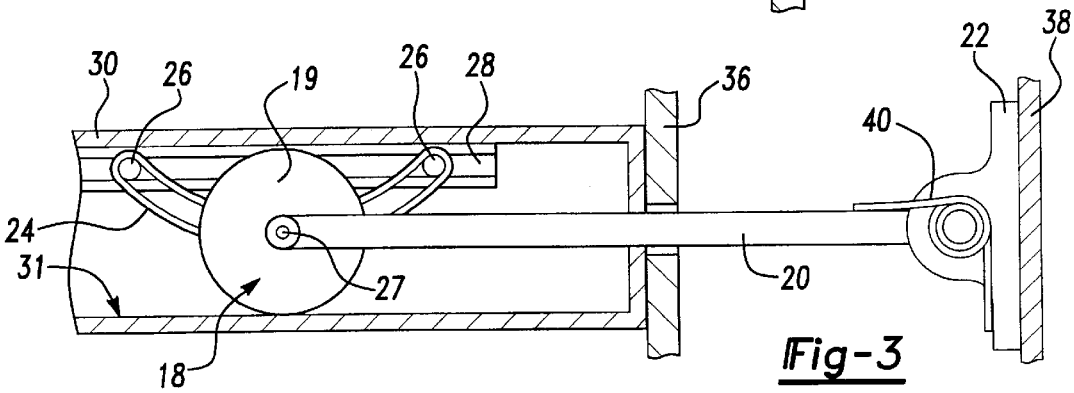
FIG. 3 is an enlarged perspective view of a fifth embodiment of the checkstrap assembly of FIG. 1 removed from the vehicle for purposes of illustration.

With continued reference to FIGS. 2–3, the arm 20 of the checkstrap assembly 10 is shown to include a first end 50 attached to the body 16 of the vehicle 12. More specifically, the first end 50, of the arm 20 is pivotally interconnected to the body 16 of the vehicle 12 through a ball joint connection with the mounting bracket 22.

Figure 4:
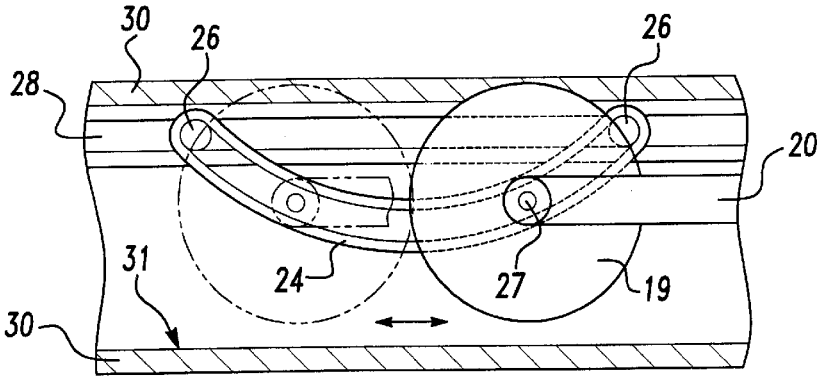
FIG. 4 is an enlarged view of the roller assembly of the checkstrap assembly of FIG. 1, illustrating the brake position while moving the door between a fully closed and open position.

With particular reference to FIG. 4, the operation of the checkstrap assembly 10 heretofore detailed will now be described. Although not specifically illustrated individually, the dynamic translation of the brake disk 19 along the carriage 24 exists for all embodiments of the present invention. The first position represents the brake disk 19 and arm 20 locations as the vehicle door 14 of vehicle 12 is being opened. The phantom line represents the brake disk 19 and arm 20 as the vehicle door 14 of vehicle 12 is being closed. As the vehicle door 14 is moved between a fully open position and fully closed position, the arm 20 and brake disk 19 slide along the carriage 24 accordingly. The roller units 26 remain at the ends of the carriage 24 and traverse along the guide 28 as the vehicle door 14 is moved. A dynamic state results in the brake disk 19 rising up the carriage 24 thus avoiding contact with the support face 31 of the housing 30 and allowing for free movement of the vehicle door 14.

Alternatively, as shown in FIG. 2*a*, a static state allows the brake disk 19 to be centralized in the carriage 24 and biased against the support face 31 of housing 30 from spring 32. In FIG. 3, a static state allows the brake disk 19 to be centralized in the carriage 24 and biased against the support face 31 of housing 30 from torsion spring 40. In the static state, as shown in FIGS. 2 and 3, the brake disk 19 acts to hold the door 14 in an infinite number of fixed positions relative to the door frame. Specifically, the movement of the carriage 24 along the guide 28 allows the brake disk 19 to be located in an infinite number of positions relative to the support surface 31 to provide a door checkstrap system with an infinite number of fixed positions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle door check assembly for use with a door of a vehicle for holding the door in an infinite number of positions relative to a door frame, comprising;

an arm having a first end adapted to be connected with the door frame;

a brake member disposed on a second end of said arm;

a guide adapted to be affixed in said door;

a carriage member slidably mounted on said guide, said carriage member defining a carriage slot; and a support face running parallel to said guide;

wherein said brake member is engaged with said carriage slot and is biased toward said support face, such that in a static state said brake member engages said support face to provide a braking force therebetween and in a dynamic state said brake member travels along said carriage slot and is separated from said support face.

2. The check assembly according to claim 1, wherein said carriage member is slidably mounted on said guide.

3. The check assembly according to claim 2, wherein said carriage member has two ends which are mounted to said guide in said door.

4. The check assembly according to claim 1, wherein a torsion spring biases said arm toward said support face.

5. The check assembly according to claim 1, wherein said guide and said support face are supported within a housing, said housing further supporting a biasing device disposed against said arm and biasing said arm toward said support face.

6. The check assembly according to claim 1, wherein said brake member is magnetically biased to said support face.

7. The check assembly according to claim 1, wherein said brake member includes a deformable material disposed thereon.

8. The check assembly according to claim 1, wherein said support face includes a deformable material disposed thereon.

* * * * *